US009480329B2

(12) United States Patent
Huybreckx

(10) Patent No.: US 9,480,329 B2
(45) Date of Patent: Nov. 1, 2016

(54) BRUSH PARTS HOLDER

(71) Applicant: KOTI Onroerend Goed b.v., Weert (NL)

(72) Inventor: Michel Jozef Rene Lambert Huybreckx, Weert (NL)

(73) Assignee: KOTI ONROEREND GOED B.V., Weert (NL)

( * ) Notice: Subject to any disclaimer, the term of this patent is extended or adjusted under 35 U.S.C. 154(b) by 0 days.

(21) Appl. No.: 14/658,953

(22) Filed: Mar. 16, 2015

(65) Prior Publication Data

US 2015/0265040 A1 Sep. 24, 2015

(30) Foreign Application Priority Data

Mar. 24, 2014 (NL) ..... 1040743
Feb. 19, 2015 (EP) ..... 15075009

(51) Int. Cl.

| | |
|---|---|
| ***A46B 7/04*** | (2006.01) |
| ***A46B 3/14*** | (2006.01) |
| ***A46B 3/16*** | (2006.01) |
| ***A46B 7/10*** | (2006.01) |
| ***A46B 13/00*** | (2006.01) |
| *E01H 5/09* | (2006.01) |

(52) U.S. Cl.

CPC ..... *A46B 7/044* (2013.01); *A46B 3/14* (2013.01); *A46B 7/10* (2013.01); *A46B 13/005* (2013.01); *A46B 3/16* (2013.01); *A46B 2200/3066* (2013.01); *E01H 5/092* (2013.01)

(58) Field of Classification Search

CPC ..... A46B 3/14; A46B 3/16; A46B 7/04; A46B 7/042; A46B 7/044; A46B 7/10; A46B 13/001; A46B 13/003; A46B 13/005; A46B 2200/3066

USPC ..... 15/179, 181–183, 198, 199, 202

See application file for complete search history.

(56) References Cited

U.S. PATENT DOCUMENTS

| | | | | | |
|---|---|---|---|---|---|
| 712,322 | A | * | 10/1902 | McIndoe | A46B 13/001 15/179 |
| 875,464 | A | * | 12/1907 | Schurmacher | A46B 3/16 15/195 |
| 1,961,926 | A | * | 6/1934 | Gerhardt | A46B 13/001 15/198 |
| 3,526,919 | A | | 9/1970 | Byers | |
| 3,529,314 | A | | 9/1970 | Clark | |
| 5,016,311 | A | * | 5/1991 | Young | A46B 13/005 15/179 |
| 5,233,719 | A | * | 8/1993 | Young | A46B 3/16 15/179 |

FOREIGN PATENT DOCUMENTS

| | | | |
|---|---|---|---|
| DE | 1018839 | * | 11/1957 |
| EP | 2020192 | A | 2/2009 |
| FR | 663482 | * | 8/1929 |
| GB | 386633 | * | 1/1933 |
| GB | 1251259 | A | 10/1971 |

* cited by examiner

*Primary Examiner* — Mark Spisich

(74) *Attorney, Agent, or Firm* — R. Neil Sudol; Henry D. Coleman

(57) ABSTRACT

The invention relates to a brush parts holder (2) being slidable in segments with sliding elements (7) in corresponding executed circumferential elements (8) of a customary brush core (1) of a brush machine, mostly a snow brush machine. The brush parts holder (2) can have different embodiments for receiving brush parts (3). A possible embodiment can also be dovetail shaped with basic holders (12) with brush threads. The advantage of using brush parts holders (2) is, that the heavy brush cores need not to be dismounted for replacing brushes, this having economical advantages.

6 Claims, 5 Drawing Sheets

BRUSH PARTS HOLDER

BACKGROUND OF THE INVENTION

The invention relates to a brush parts holder for positioning this, by means of sliding, onto known brush cores of brush machines, in particular snow brush machines.

The fixing of brush parts is taking place in the usual way on steel rings, which are slid then on the so called brush core of a brush machine. Said known steel rings, being provided with brush parts, are having a number of disadvantages. The main disadvantage is that said brush core has to be dismounted from the brush machine. Generally speaking these are heavy and difficult to handle cylinders having a length of about 6 meter. After removing the old rings with brush parts said thin steel rings with the brush parts have to be slid one by one and by hand onto the long cylindrical brush core. The composition is expensive concerning provisions and labour hours. Briefly said the known system of thin steel rings, being provided with brush parts, is having a number of disadvantages.

OBJECT OF THE INVENTION

The object of the present invention concerns the provision of a modified, improved system for the renewed mounting of brush parts, said system not having the disadvantage above.

SUMMARY OF THE INVENTION

According to the invention a brush parts holder is developed in an inventive way being characterized in that said brush parts holder is having the shape of a cylindrical ringportion with central point angle α (alfa), ring thickness P and cylindrical ring length L, at the inside being provided with at least two sliding elements for mounting corresponding circumferential elements.

The advantage is that, according to the invention, said brush core need not to be dismounted when after use the brush parts are worn. Only said circular endplate has to be unscrewed and segmentally said old brush parts holders can be slid on according to the invention. This provides great advantages in use and concerning costs.

Moreover, according to the invention, said brush parts holder is improved further and is characterized in that said brush parts holder is provided at its outside with staggering rows of bores with diameter D and pitch K, in which succeeding parallel rows are staggered over a pitch of 0,5 K.

The advantage is, that a very dense brush is obtained without grooves.

According to the invention said brush parts holder is further developed and is characterized in that the number of sliding elements is at least two and are having a rail shape for suitable sliding into the circumferential elements along the circumference of said brush cores and having a length L in which the mutual distance of said sliding elements can be adapted to the number and shape of said circumferential elements of the existing either the customary brush cores.

The advantage is, that a brush parts holder is obtained which can be used universally.

BRIEF DESCRIPTION OF THE DRAWINGS

The invention is further elucidated below on hand of a preferred embodiment shown in the drawing. In this shows.

DETAILED DESCRIPTION

Figure 1:
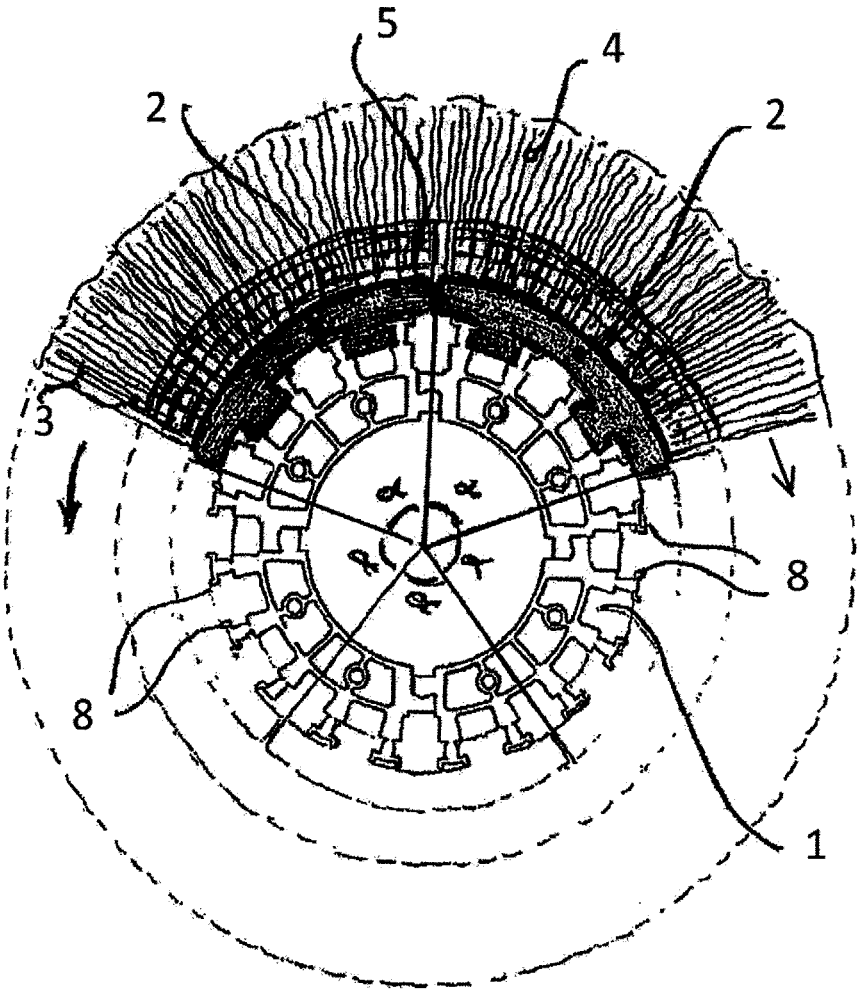
FIG. 1 a side view of a pair of brush parts holders positioned on a brush core.
Figure 2:
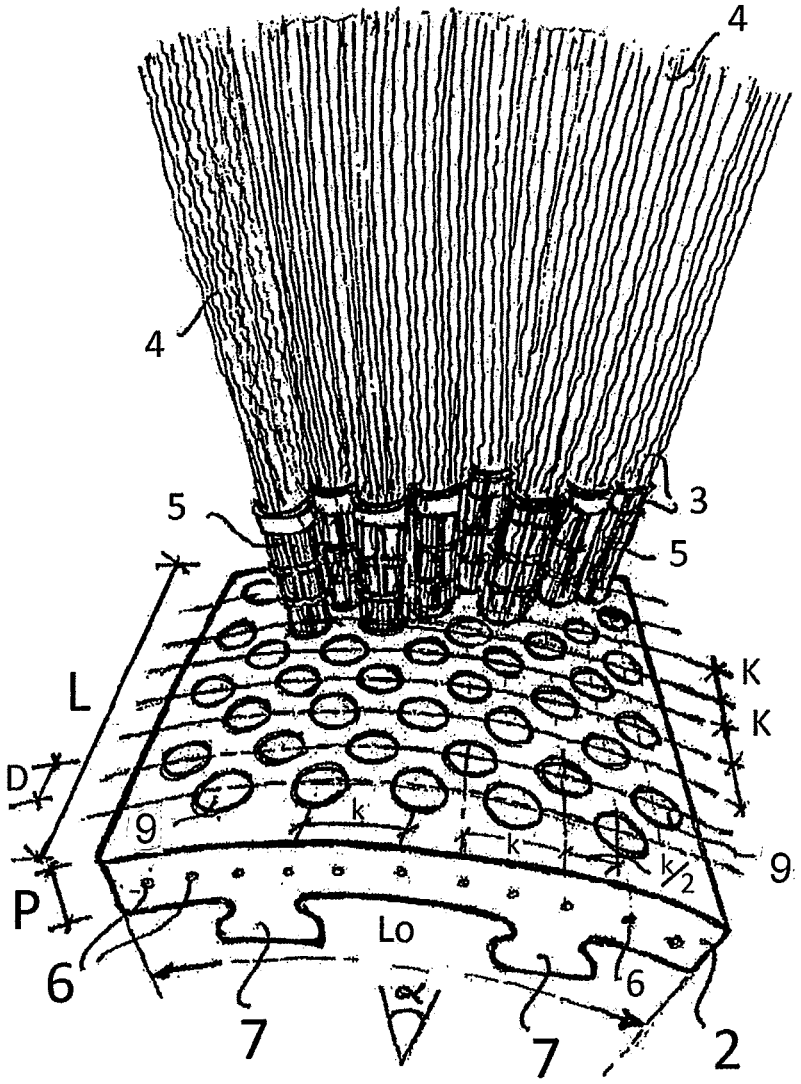
FIG. 2 a front view, in oblique projection, of a brush parts holder according to the invention, provided with a number of brush parts, in which the succeeding rows of bores are staggered.

FIG. 1 shows a side view of a brush core 1 in which already two brush parts holders 2 are positioned along the circumference. In said brush parts holders 2 brush parts 3 are positioned having steel brush hairs 4 which are previously zigzag shaped and with a clamping thread (not shown) are fixed in the holders 5. Said holders 5 are fixed in said brush part holders 2 by means of safety threads 6 (FIG. 2). In this way the shown brush core 1 can comprise five brush parts holders 2 having a central point angle 2/pi/5 radians. The brush parts holders 2 can be adapted to the existing and used brush cores e.g. for 6, 7 or 8 brush parts holders. An existing brush core is described in the patent application EP 13075071, title "Connection Segmental Parts Brush Core". In this the specific construction of the brush core is described.

FIG. 2 shows a front view in oblique projection of the brush parts holder 2 with a number of positioned brush parts 3. Said brush parts holder 2 comprises two sliding elements 7, the mutual distance of these being dependant on the circumferential elements 8 of said brush core (see FIG. 1 and FIG. 3). Along the outside of the brush parts holder 2 rows of bores 9 are provided, The succeeding rows of bores 9 are staggered near two succeeding rows over the distance K. The staggering of two succeeding rows of bores with diameter D is K/2.The dimensions of the brush parts holder 2 are L×LO×P. In this L is between 200 mm and 500 mm and preferably about 300 mm. The length LO depends on the related brush core 1. Thickness P lies between 10 mm and 40 mm, preferably 30 mm. For angle α see FIG. 1.

Figure 3:
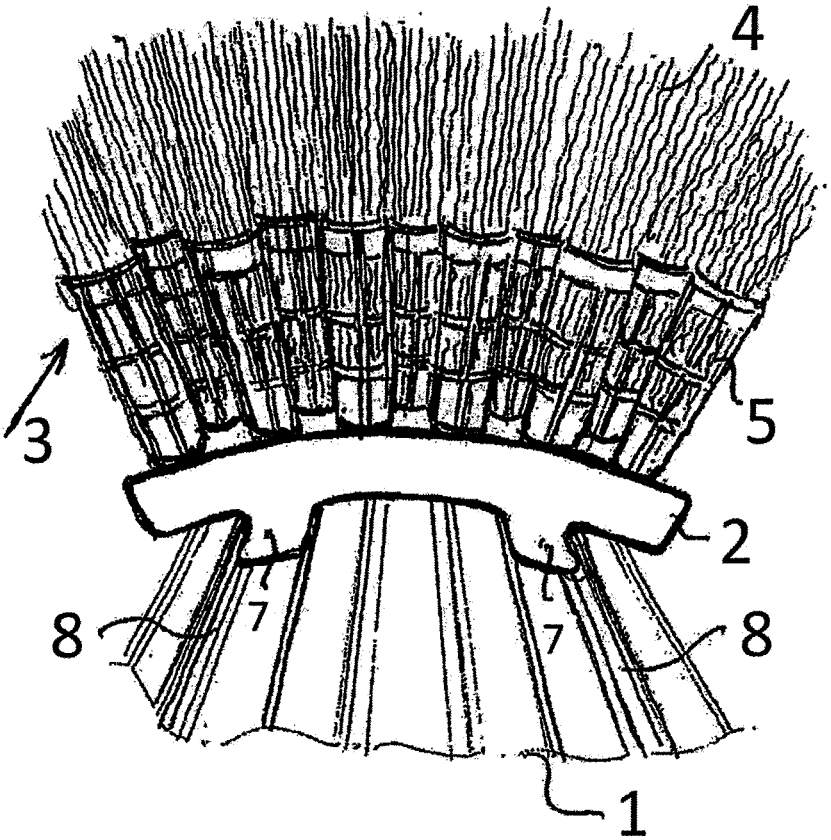
FIG. 3 a view of a filled brush parts holder with brush parts slid on the circumferential profile of a brush core.

FIG. 3 shows a view of a brush parts holder 2 filled with brush parts 3, said holder being slid in the circumferential elements 8 of the brush core with the sliding elements 7.

Figure 4:
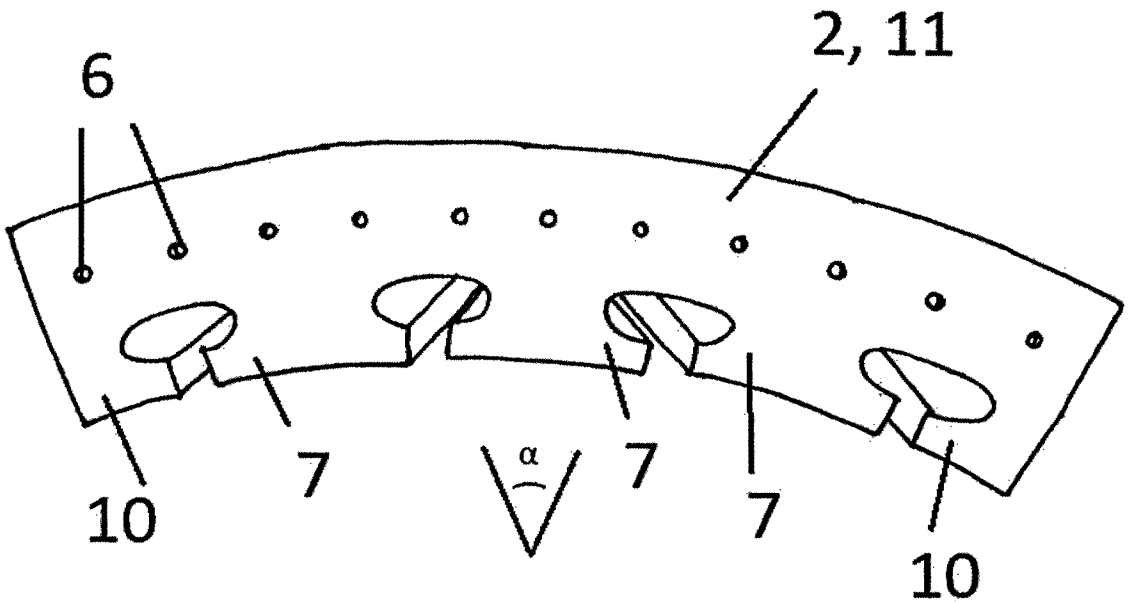
FIG. 4 a side view of said brush parts holder without brush parts. according to the invention, with the maximum number of sliding elements.

FIG. 4 shows a side view of the brush parts holder 2, 11 without brush parts 3 with a maximum number of sliding elements 7, 10. The sliding elements 10 are half elements. The number of security threads 6 can be adapted to the number of the rows of bores 9.

Figure 5:
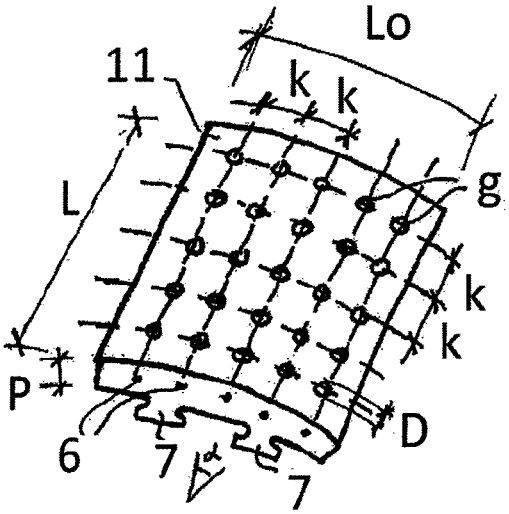
FIG. 5 a view, in oblique projection, of the brush parts holder without brush parts, in which the succeeding rows of bores are not staggered.

FIG. 5 shows a view in oblique projection of the brush parts holder 11 without brush parts 3, in which the succeeding rows of bores 9 are not staggered.

Figure 6:
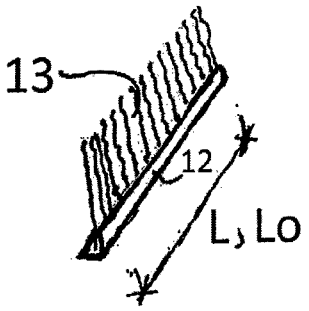
FIG. 6 a view, in oblique projection, of an, in cross section, dovetail shaped basic holder with brush threads for placing in the dovetail grooves along the outer circumference of a modified brush parts holder.
Figure 7:
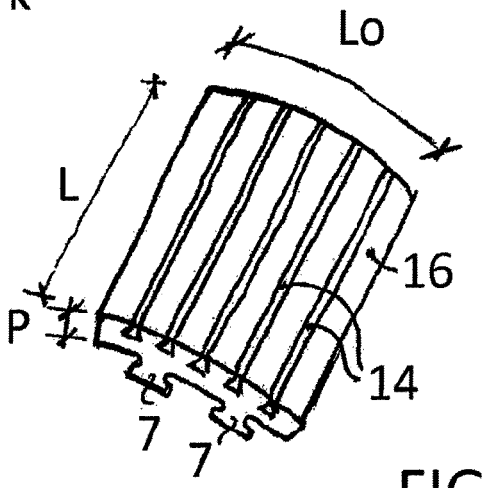
FIG. 7 a view, in oblique projection, of the modified brush parts holder for brush threads with dovetail shaped grooves in longitudinal direction along the outer circumference.
Figure 8:
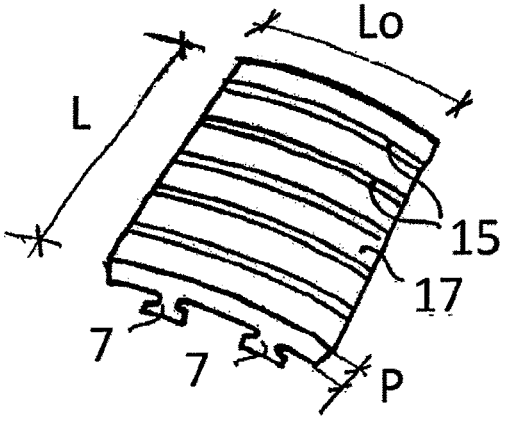
FIG. 8 a view, in oblique projection, of the modified brush parts holder for brush threads with dovetail grooves in cross direction along the outer circumference.

FIG. 6 shows a view in oblique projection of an elongate dovetail shaped basic holder or strip 12 with in it a locked row of brush threads or bristles 13 for mounting by sliding into corresponding dovetail shaped grooves 14, 15 along the outer circumference of the modified brush holders 16, 17 of the FIGS. 7 and 8.

Finally it has to be remarked that a preferred embodiment of the invention is described above and that it is self-evident, that further modifications are possible without leaving the scope of this patent specification.

The invention claimed is:

1. Brush parts assembly including a brush parts holder positionable by sliding onto known brush cores of brush machines, wherein said brush parts holder has the shape of a cylindrical ring portion with central point angle $\alpha$, ring thickness P and cylindrical length L, and along an inner side is provided with at least two sliding elements for mounting into corresponding circumferential elements, said brush parts assembly further including elongate strips each dove-tail in cross-section and each holding a linear array or row of brush bristles, said cylindrical ring portion being provided in an outer surface opposite said inner side with elongate grooves dove-tail in cross-section, said strips being configured for sliding insertion into said grooves.

2. Brush parts assembly according to claim 1, wherein said ring thickness P lies between 20 mm and 40 mm, and wherein the ring length L lies between 200 mm and 500 mm.

3. Brush parts assembly according to claim 1, wherein said central point angle $\alpha$ lies between 2 pi/10 radians and 2 pi/4 radians.

4. Brush parts assembly according to claim 1, wherein the number of the sliding elements is at least two and wherein the sliding elements have a rail shape for suitable sliding in said circumferential elements along circumferences of the brush cores and have a length L and a mutual distance or spacing adapted to number and shape of said circumferential elements of the brush cores.

5. Brush parts assembly according to claim 1, wherein said brush parts holder is made of plastic material.

6. Brush parts assembly according to claim 5, wherein said plastic material is polypropylene.

* * * * *